US008110077B2

(12) United States Patent
Muramatsu et al.

(10) Patent No.: US 8,110,077 B2
(45) Date of Patent: Feb. 7, 2012

(54) SEALING JIG AND PLATING TREATMENT APPARATUS

(75) Inventors: Hitoshi Muramatsu, Hamamatsu (JP); Seiya Kunioka, Hamamatsu (JP); Nobuyuki Suzuki, Toyohashi (JP); Akira Ishibashi, Hamamatsu (JP); Minoru Imai, Iwata (JP); Manabu Suzuki, Hamamatsu (JP); Masahiro Ogawa, Hamamatsu (JP)

(73) Assignee: Suzuki Motor Corporation, Hamamatsu-shi, Shizuoka-Ken (JP)

( * ) Notice: Subject to any disclaimer, the term of this patent is extended or adjusted under 35 U.S.C. 154(b) by 504 days.

(21) Appl. No.: 12/390,974

(22) Filed: Feb. 23, 2009

(65) Prior Publication Data

US 2009/0223813 A1 Sep. 10, 2009

(30) Foreign Application Priority Data

Mar. 6, 2008 (JP) ..... 2008-056341

(51) Int. Cl.
*C25D 17/00* (2006.01)

(52) U.S. Cl. ..... 204/224 R

(58) Field of Classification Search ..... 205/131; 204/279, 224 R
See application file for complete search history.

(56) References Cited

U.S. PATENT DOCUMENTS 4,017,376 A * 4/1977 Mose et al. ..... 204/258
5,580,383 A * 12/1996 Ikegaya et al. ..... 118/317

FOREIGN PATENT DOCUMENTS

JP 8-144082 6/1996
JP 8-199390 8/1996

* cited by examiner

*Primary Examiner* — Luan Van
(74) *Attorney, Agent, or Firm* — Barnes & Thornburg LLP

(57) ABSTRACT

A sealing jig comes into contact with a cylinder inner peripheral surface as a surface to be processed of a cylinder block and seals the cylinder inner peripheral surface in introducing treatment liquid to the cylinder inner peripheral surface. The sealing jig includes: a sealing member made of an expandable material and having a ring-buoy shape; a lower plate for supporting a lower side of the sealing member; and a seal base disposed so as to face the lower plate and to support an upper side of the sealing member. The sealing member is regulated by the lower plate and the seal base and expanded only in a radial direction to come into contact with the cylinder inner peripheral surface when air is introduced inward.

7 Claims, 8 Drawing Sheets

SEALING JIG AND PLATING TREATMENT APPARATUS

This United States Non-Provisional Utility patent application claims priority to and relies for priority upon Japanese Patent Application No. 2008-056341, which was filed on Mar. 6, 2008.

BACKGROUND OF THE INVENTION

1. Field of the Invention

The present invention relates to a sealing jig or fixture for sealing a cylinder inner peripheral surface which is a surface to be processed of a cylinder block of an engine, for example, at a time when treatment liquid is introduced to an inner peripheral surface of a cylinder and also relates to a plating treatment apparatus provided with such sealing jig for performing pre-plating or plating process to the cylinder inner peripheral surface.

2. Related Art

Conventionally, there is known a method for sealing a cylinder inner peripheral surface of a cylinder block in an apparatus for performing surface treatment such as plating treatment on the cylinder inner peripheral surface by introducing treatment liquid to the cylinder inner peripheral surface.

In a surface treatment apparatus described, for example, in Japanese Patent Application Laid-Open Publication No. 8-199390, diameter of a cylinder is completely expanded by repeating an operation of expanding the diameter of a sealing member and an operation of moving the entire sealing jig including the sealing member within the cylinder, and thereafter, the sealing operation is performed to the cylinder inner peripheral surface.

Furthermore, Japanese Patent Application Laid-Open Publication No. 8-144082 discloses a surface treatment apparatus in which an air tube is expanded so as to contact the cylinder inner peripheral surface, thereby sealing the cylinder inner peripheral surface.

However, the surface treatment apparatus described in Japanese Patent Application Laid-Open Publication No. 8-199390 has the following drawbacks. That is, when some failure occurs in adjustment of an expanding amount of a sealing member or adjustment of a moving amount of a sealing jig, the cylinder inner peripheral surface to be processed may be damaged, or sealing position with respect to the cylinder inner peripheral surface may be deviated, thus lowering sealing position accuracy.

In the surface treatment apparatus described in Japanese Application Laid-Open Publication No. 8-144082, it may become impossible to control a shape or sealing position of the air tube during the expansion because of insufficient positioning of the air tube. Accordingly, in this case, the sealing position accuracy of the cylinder inner peripheral surface may be insufficient.

SUMMARY OF THE INVENTION

In view of the circumstances encountered in the prior art mentioned above, an object of the present invention is to provide a sealing jig capable of improving sealing position accuracy on a surface to be processed and a plating treatment apparatus including such sealing jig.

The above and other objects can be achieved according to one aspect of the present invention by providing a sealing jig for sealing an inner peripheral surface of a cylinder in contact with the cylinder inner peripheral surface as a surface to be processed of a cylinder block at a time of introducing treatment liquid to the cylinder inner peripheral surface, the sealing jig including:

a sealing member made of an expandable material and having a ring-buoy shape;

a seal support member for supporting one side of the sealing member; and a seal base disposed so as to face the seal support member and adapted to support another side of the sealing member, wherein when the treatment liquid is introduced inward, the sealing member is expanded only in a radial direction under regulation of the seal support member and the seal base so as to come into contact with the cylinder inner peripheral surface.

In a preferred embodiment of the above aspect, the seal support member or the seal base may be provided with a fluid flow path including a blowing-off hole for blowing off fluid, the blowing-off hole is closed by the sealing member when the sealing member is expanded in a radial direction and is opened when the sealing member is contracted, and a contacting condition of the sealing member with the cylinder inner peripheral surface is confirmed in accordance with a pressure in the fluid flow path.

It may be desired that a plurality of fluid flow paths including the blowing-off hole is formed in a circumferential direction of the sealing member.

It may be also desired that fluid supplied to an interior of the sealing member and fluid supplied to an interior of the fluid flow path including the blowing-off hole are air.

In another aspect of the present invention, there is also provided a plating treatment apparatus performing a plating treatment to an inner surface of a cylinder, the plating treatment apparatus comprising:

an apparatus body provided with an electrode support member;

an electrode supported by the electrode support member to be movable;

a sealing jig mounted to the electrode;

a work support jig holding a work such as a cylinder block; and a treatment liquid supply member supported by the electrode support member for supplying a treatment liquid between the electrode and the sealing jig, the sealing jig including:

a sealing member made of an expandable material and having a ring-buoy shape;

a seal support member for supporting one side of the sealing member; and a seal base disposed so as to face the seal support member and adapted to support another side of the sealing member, wherein when the treatment liquid is introduced inward, the sealing member is expanded only in a radial direction under regulation of the seal support member and the seal base so as to come into contact with the cylinder inner peripheral surface.

In a preferred embodiment of this aspect, it may be desired that the seal support member for the sealing jig is installed on the electrode and a communication hole through which the treatment fluid inflows and outflows between the electrode inside and the cylinder inner peripheral surface side is formed in a vicinity of the seal support member.

The seal support member may be made of metal and disposed on the electrode through an insulation member, the seal support member has a protrusion having an outer diameter larger than that of the electrode, and an insulating cover is mounted onto the protrusion.

The seal support member may include a protrusion having an outer diameter larger than that of an electrode and may be made of an insulation member and installed directly on the electrode or through an insulation member.

According to the present invention of the aspects mentioned above, the sealing jig and the plating treatment apparatus including the sealing jig allow a sealing member to be expanded only in a radial direction and come into contact with a cylinder inner peripheral surface during introduction of fluid into the inside, thereby improving sealing position accuracy with respect to the cylinder inner peripheral surface which is a surface to be processed.

The nature and further characteristic features of the present invention will be made clearer from the following descriptions made with reference to the accompanying drawings.

DESCRIPTION OF THE PREFERRED EMBODIMENTS

Preferred embodiments of the present invention will be described hereunder with reference to the accompanying drawings. However, the present invention is not limited to these embodiments. It is further to be noted that terms "upper", "lower", "left", "right" and the like terms are used herein in an illustrated state or in an actually mounted state.

First Embodiment

FIGS. 1 to 11

Figure 1:
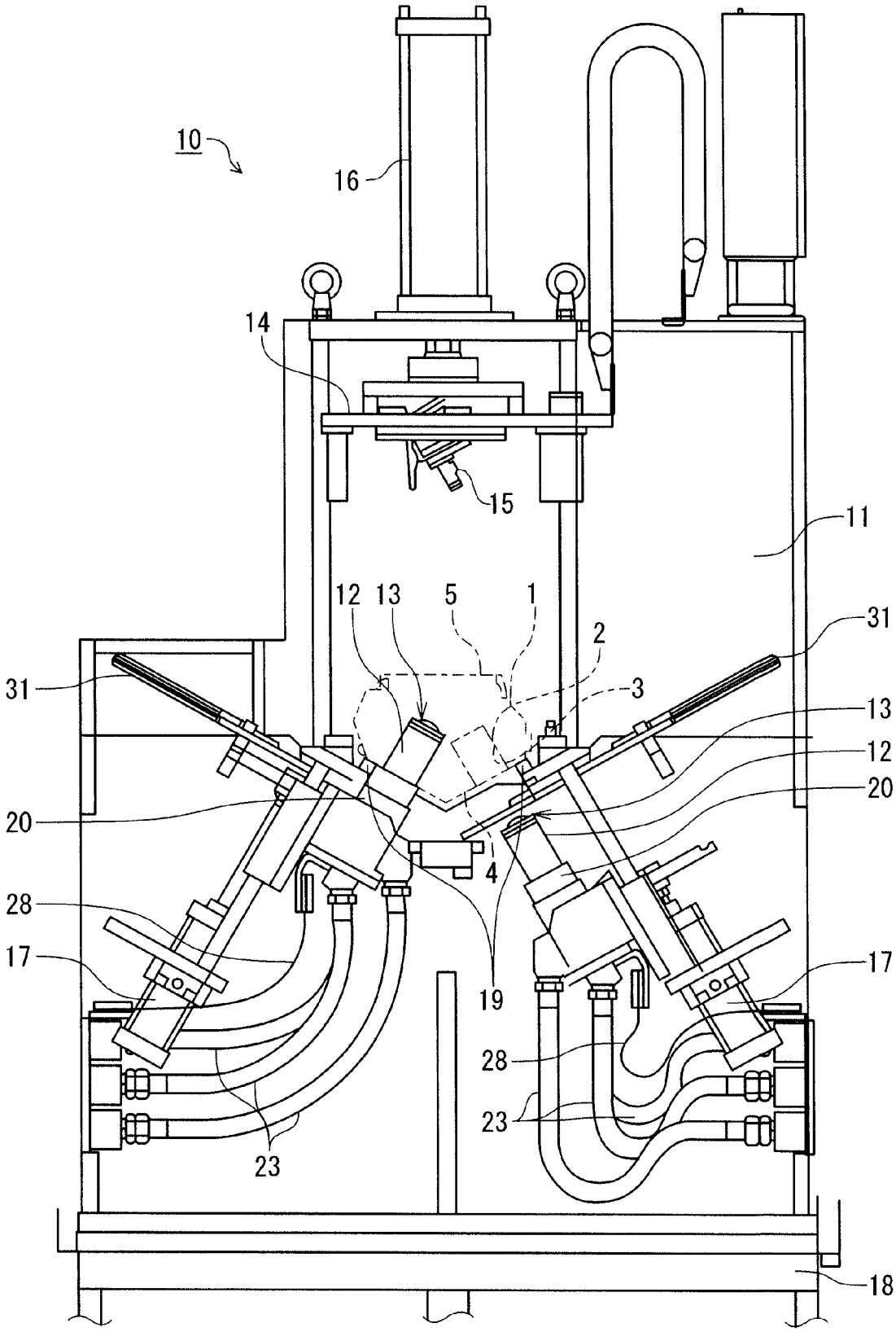
FIG. 1 is an overall front view illustrating a first embodiment of a plating treatment apparatus according to the present invention.
Figure 2:
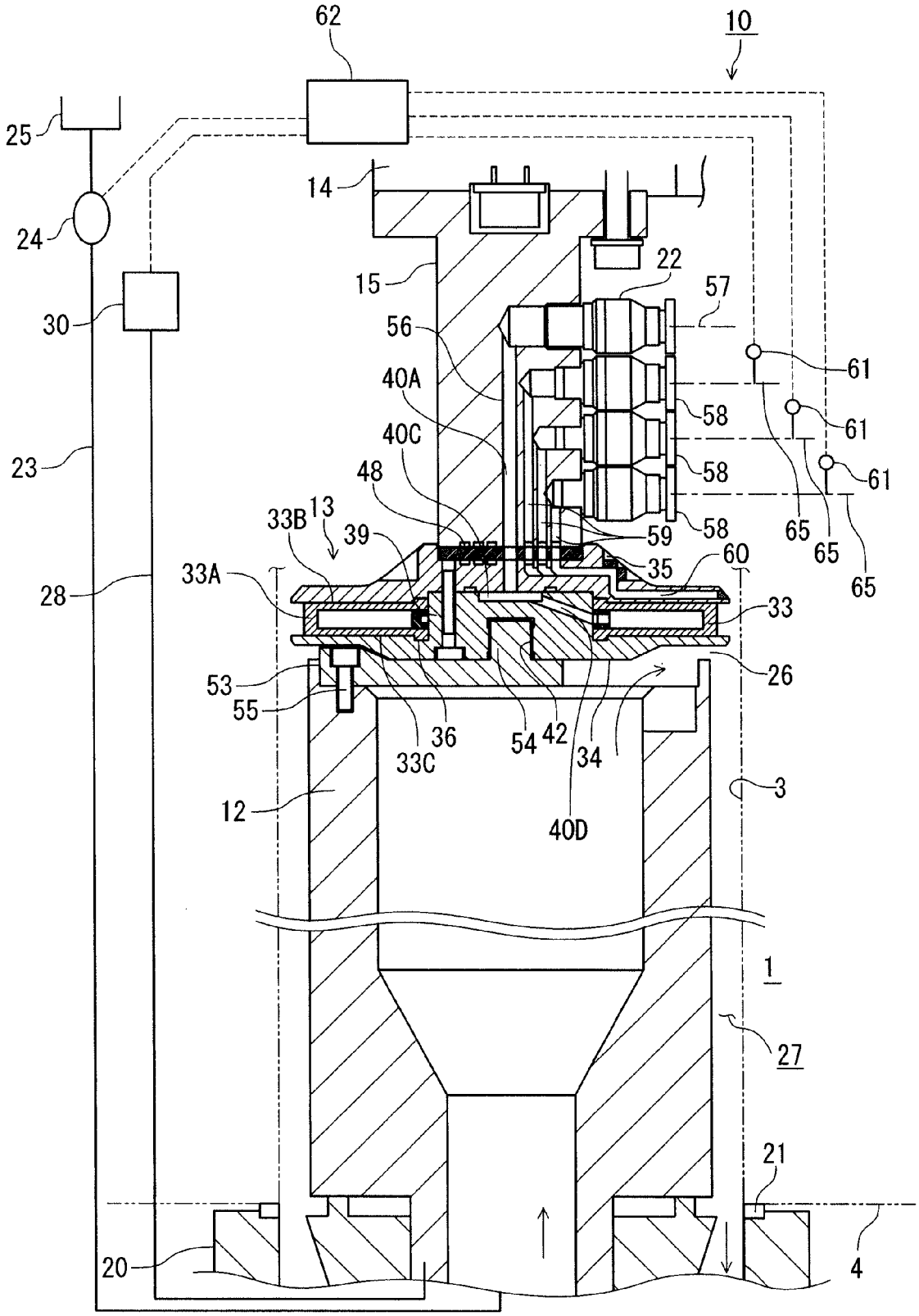
FIG. 2 is a sectional view illustrating a portion around an electrode and an air joint in the plating treatment apparatus in FIG. 1.

With reference to FIGS. 1 and 2, a cylinder inner peripheral surface 3, which is a surface to be treated, of a cylinder block 1 of an engine, for example, is pre-plated or plated at high speed by using a plating treatment apparatus 10 illustrated in FIG. 1 while introducing an treatment liquid (pre-plating liquid or plating liquid) to the cylinder inner peripheral surface 3.

The plating treatment apparatus 10 includes an apparatus body 11, an electrode 12, a sealing jig 13, a work holding jig 14, an air joint 15, a clamp cylinder 16, and an electrode cylinder 17. In the present embodiment, the cylinder block 1 is a V-type cylinder block for a V-type engine, and the cylinder inner peripheral surface 3 of a plurality of cylinders 2 formed with a predetermined angle in the cylinder block 1 is concurrently pre-plated or plated.

The apparatus body 11 is firmly installed on a base 18. The apparatus body 11 is provided with a work mounting platform 19 for mounting the cylinder block 1. The cylinder block 1 is mounted on the work mounting platform 19 with a cylinder head surface 4 directed downward.

On the apparatus body 11, the work holding jig 14 is installed above the work mounting platform so as to be vertically movable by the clamp cylinder 16. The work holding jig 14 is provided with a clamp, not shown. The work holding jig 14 comes into contact with a crankcase surface 5 of the cylinder block 1 mounted on the work mounting platform 19 at a lowered position. At this time, the clamp of the work holding jig 14 clamps the side portion of the crankcase surface 5 of the cylinder block 1 so as to hold the cylinder block 1 between the work mounting platform 19 and the work holding jig 14.

The electrode 12 is supported by an electrode supporting portion 20, and the electrode supporting portion 20 is mounted on the electrode cylinder 17 installed on the apparatus body 11. Through reciprocal motion of the electrode cylinder 17, the electrode 12 is inserted into the cylinder 2 of the cylinder block 1 and is retracted from the cylinder 2 of the cylinder block 1.

In FIG. 1, the left side electrode 12 is inserted into the cylinder 2 and in FIG. 2, the right side electrode 12 is retracted from the cylinder 2. When the electrode 12 is inserted into the cylinder 2 of the cylinder block 1, a seal ring 21 (FIG. 2) made of such as silicon rubber sheet fitted on the electrode supporting portion 20 comes into contact with the cylinder head surface 4 of the cylinder 1 so that the cylinder head surface 4 side of the cylinder inner peripheral surface 3 is sealed.

As illustrated in FIG. 1, the sealing jig 13 is mounted on an upper end of the electrode 12 and the air joint 15 is installed on the work holding jig 14. When the electrode 12 is inserted into the cylinder 2 of the cylinder block 1, the sealing jig 13 comes into contact with the air coupling 15 as illustrated in FIG. 2, and air as a fluid is supplied from a main air coupling 22 of the air joint 15 to a sealing member 33 of the sealing jig 13. Hence, the sealing member 33 is expanded only in a radial direction and comes into contact with the cylinder inner peripheral surface 3 of the cylinder block 1, and then, the crankcase surface 5 side of the cylinder inner peripheral surface 3 is sealed.

To the electrode supporting portion 20 illustrated in FIG. 1, a treatment liquid pipe 23 is connected. The treatment liquid pipe 23 is further connected to a liquid supply pump 24 (FIG. 2). In the state of the crankcase surface 5 side in the cylinder inner peripheral surface 3 of the cylinder block 1 sealed by the sealing member 33, the liquid supply pump 24 introduces a treatment liquid (pre-plating liquid or plating liquid) reserved in a reservoir tank 25 into the electrode 12 through the treatment liquid pipe 23 and the electrode supporting portion 20. The treatment liquid introduced into the electrode 12, as illustrated in FIG. 2, is introduced into a space 27 partitioned by an outer peripheral surface of the electrode 12 and the cylinder inner peripheral surface 3 of the cylinder block 1 through a slit 26 between a lower plate 34 of the sealing jig 13 and the electrode 12, and then, the treatment liquid circulates between the space 27 and the reservoir tank 25.

As illustrated in FIGS. 1 and 2, the electrode supporting portion 20 is connected to a lead wire 28, which is connected to a power supply 30. The power supply device 30 supplies electric power to the electrode 12 through the lead wire 28 and the electrode supporting portion 20 in a state that the treatment liquid fills the space 27. The power is supplied so that the electrode 12 becomes a negative pole and the cylinder block 1 becomes a positive pole in pre-plating, thereby pre-plating the cylinder inner peripheral surface 3 of the cylinder block 1. In the plating treatment, the power supply is implemented so that the electrode 12 becomes a positive pole and the cylinder block 1 becomes a negative pole so as to plate the cylinder inner peripheral surface 33 to thereby form a plating film on the cylinder inner peripheral surface 3. Plating-preprocessing and plating are performed with different treatment liquids and energizing conditions.

Although FIG. 1 illustrates only one air joint 15, the air joints 15 of the number corresponding to that of the electrodes 12 are provided on the work holding jig 14. Reference numeral 31 in FIG. 1 denotes a cleaning shutter which operates when a cleaning liquid is injected into the cylinder 2 of the cylinder block 1 for cleaning after the pre-plating or plating is applied onto the cylinder inner peripheral surface 3 of the cylinder block 1 and the electrode 12 is retracted from the cylinder block 1.

Referring next to FIGS. 2 to 11, configurations of the sealing jig 13 and the air joint 15 will be described.

The sealing jig 13 includes the sealing member 33, the lower plate 34 and a seal base 35 and serves to seal the cylinder inner peripheral surface 3 in contact with the cylinder inner peripheral surface 3 at the time when the treatment liquid is introduced to the cylinder inner peripheral surface 3 of the cylinder block 1.

Figure 3A:
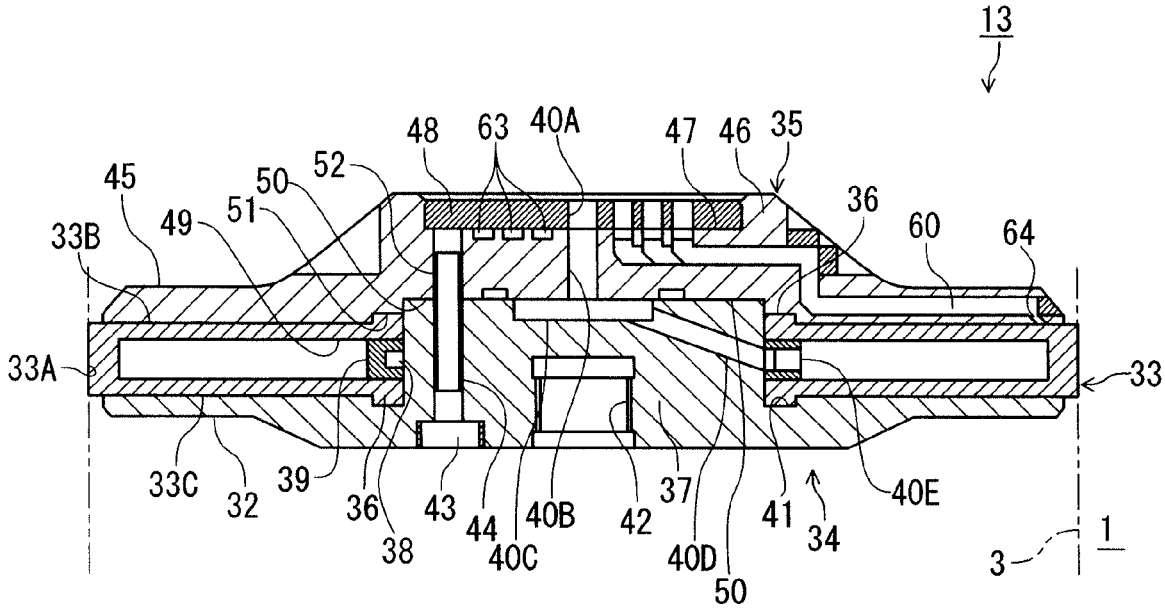
FIG. 3A is a sectional view illustrating an expanded state of a sealing member of a sealing jig in FIG. 2
Figure 3B:
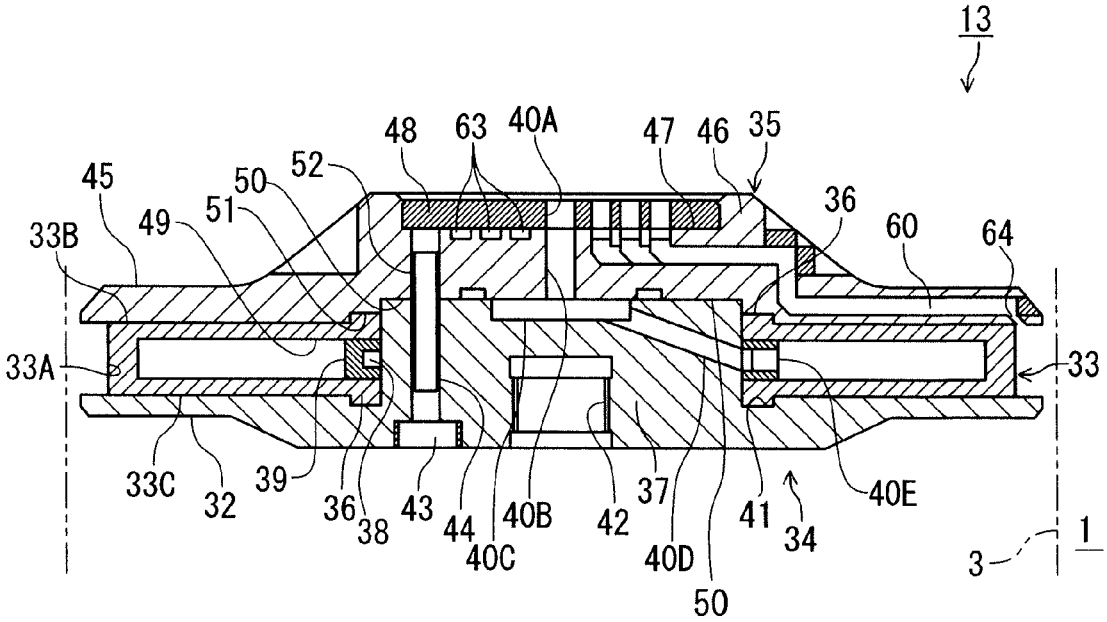
FIG. 3B is a sectional view illustrating a contracting state of the sealing member.
Figure 4:
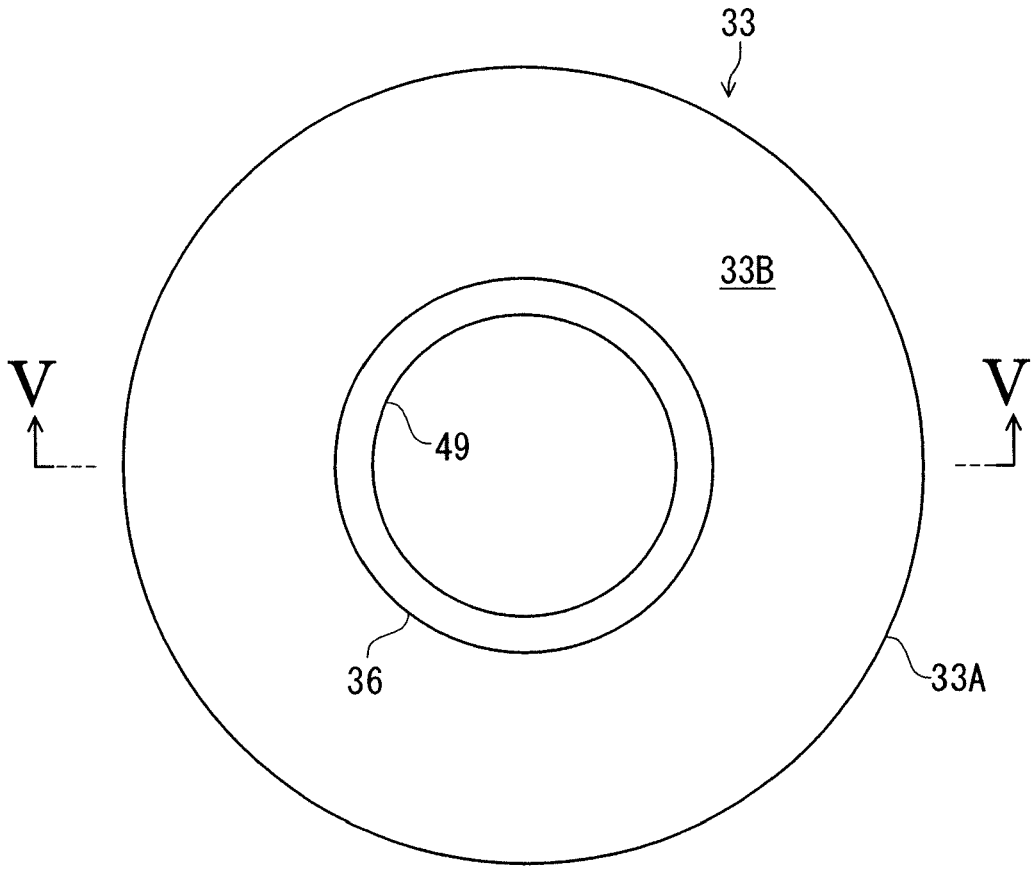
FIG. 4 is a plan view illustrating the sealing member in FIG. 3.
Figure 5:
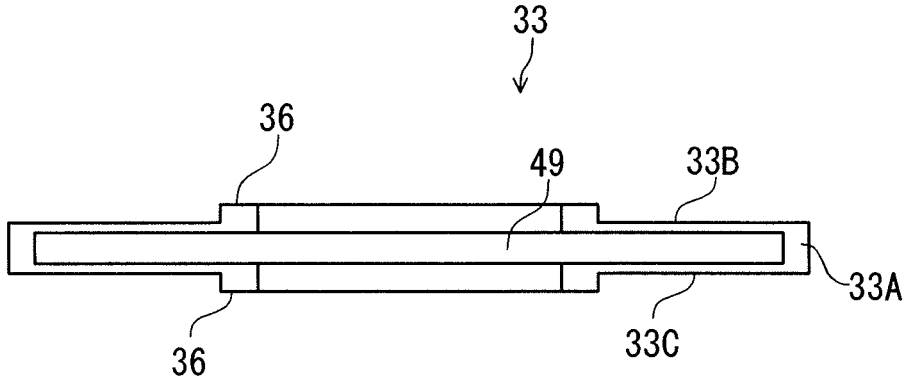
FIG. 5 is a sectional view taken along the line V-V in FIG. 4.

The sealing member 33, as illustrated in FIGS. 3 to 5, is made of an expandable material, such as an elastic member like a rubber and is formed into a ring-buoy shape. An inner peripheral portion of the sealing member 33 is opened and provided with an opening portion 49, and an engaging protrusion 36 is formed on both sides in the vicinity of the opening portion 49. An outer peripheral portion 33A of the sealing member 33 is configured to be contactable with the cylinder inner peripheral surface 3 of the cylinder block 1.

Figure 6:
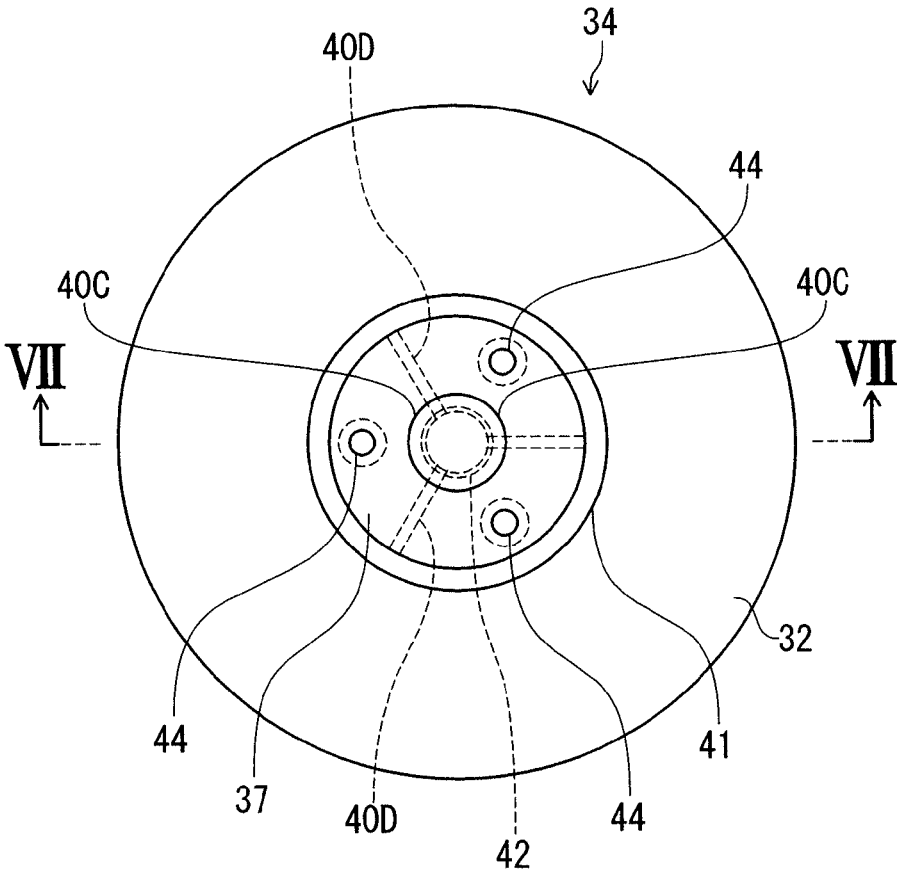
FIG. 6 is a plan view illustrating a lower plate as the seal support member in FIG. 3.
Figure 7:
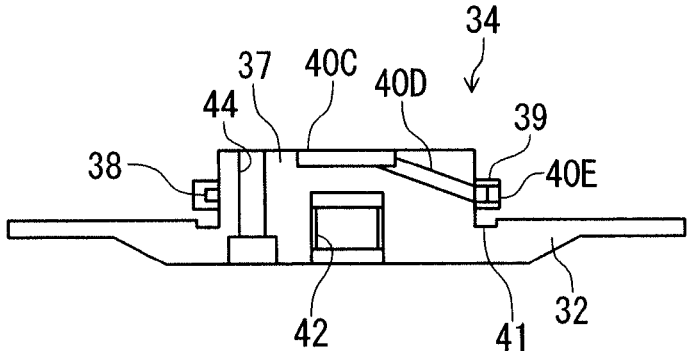
FIG. 7 is a sectional view taken along the line VII-VII in FIG. 6.

The lower plate 34 is formed, as illustrated in FIGS. 3, 6, and 7, so that a swelling portion 37 is integrally formed in the center of a disc portion 32. A ring member 39 formed with a peripheral groove 38 is disposed on an outer periphery of the swelling portion 37. The swelling portion 37 is formed with main air flow paths 40C and 40D communicating with each other. A plurality of, for example, three, main air flow paths 40D are formed at uniform intervals in a circumferential direction of the lower plate 34. The main air flow paths 40D communicate with the peripheral groove 38 in the ring member 39 and further communicate with main air flow paths 40E formed so as to communicate with the peripheral groove 38. A plurality of the main air flow paths 40E, for example three, is formed in the circumferential direction of the ring member 39.

On the disc portion 32 of the lower plate 34, an engaging groove 41 is formed into a ring shape at a boundary portion to the swelling portion 37. The engaging protrusion 36 of the sealing member 33 engages with the engaging groove 41. In addition, a fastening internal thread portion 42 and a bolt through-hole 44 for inserting a bolt 43 are formed on the disc portion 32 and the swelling portion 37.

As illustrated in FIG. 3, the lower plate 34 is structured so that the disc portion 32 supports a side surface (a lower side surface 33C in FIG. 3) of the sealing member 33 in such a state that the opening portion 49 of the sealing member 33 is fitted to the ring member 39 and the engaging protrusion 36 of the sealing member 33 engages with the engaging groove 41.

Figure 8:
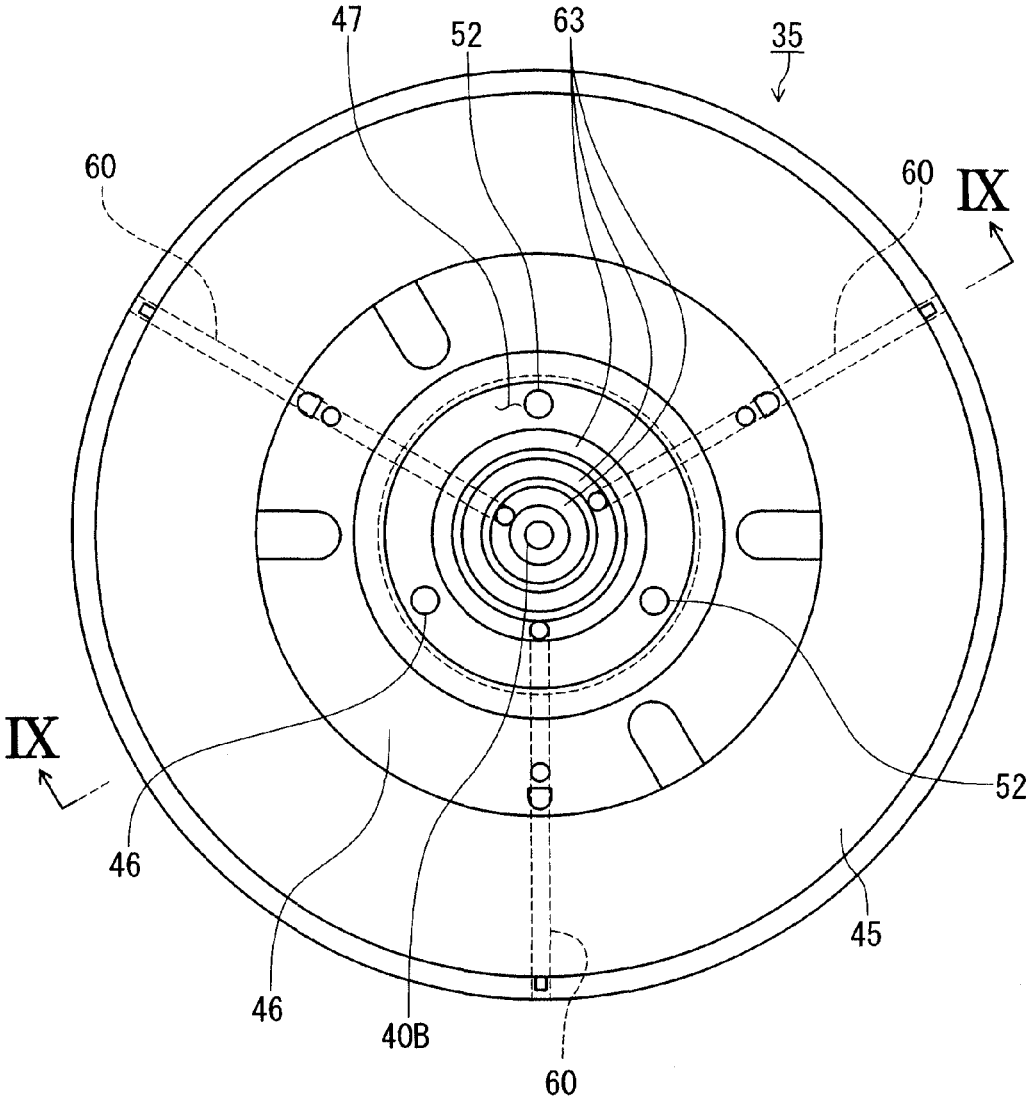
FIG. 8 is a plan view illustrating a seal base in FIG. 3.
Figure 9:
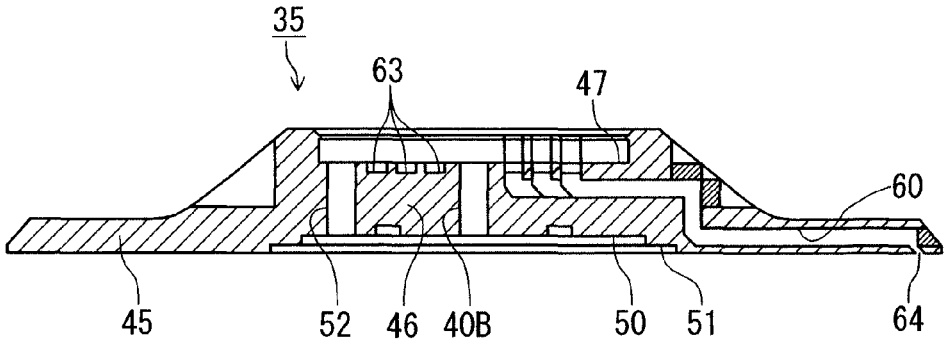
FIG. 9 is a sectional view taken along the line IX-IX in FIG. 8.

In the seal base 35, as illustrated in FIGS. 3, 8, and 9, a swelling portion 46 is integrally formed in the middle of the disc portion 45, and the swelling portion 46 is formed with a seating portion 47 and a main air flow path 40B. A seal sheet 48 is fitted to the seating portion 47, and a main air flow path 40A communicating with a main air flow path 40B is bored through the seal sheet 48. The main air flow path 40B is formed to communicate with a main air flow path 40C of the lower plate 34.

Further, the disc portion 45 is formed with a recessed portion 50 into which the swelling portion 37 of the lower plate 34 is fitted at a position opposite to the seating portion 47, and an engaging groove 51 is formed into a ring shape outside the recessed portion 50. The swelling portion 37 of the lower plate 34 and the engaging protrusion 36 of the sealing member 33 are engaged respectively with the concentric recessed portions 50 and 51, each in stepped shape, formed on the opposite side of the seating portion 47 of the disc portion 45. A threaded bolt hole 52 for screwing a bolt 43 is formed through the disc portion 45 and the swelling portion 46.

As illustrated in FIG. 3, in a state that the swelling portion 37 of the lower plate 34 is fitted into the recessed portion 50 in the seal base 35, the opening portion 49 of the sealing member 33 is fitted to the ring member 39 of the lower plate 34, and the engaging protrusion 36 of the sealing member 33 is fitted into the engaging groove 41 on the lower plate 34. The engaging groove 51 of the seal base 35, the sealing member 33, the lower plate 34 and the seal base 35 are integrated by screwing the bolt 43 into the bolt threaded hole 44 of the lower plate 34 and the threaded bolt hole 52 of the seal base 35, thus constituting the sealing jig 13.

Under such a condition, the lower plate 34 and the seal base 35 are disposed so as to face each other, and the disc portion 32 of the lower plate 34 supports a side surface (a lower side surface 33C in FIG. 3) of one side of the sealing member 33, while the disc portion 45 of the seal base 35 supports a side surface (an upper side surface 33B) of the other side of the sealing member 33 in surface-contacting state.

In addition, the sealing member 33, the lower plate 34 and the seal base 35 are integrated, and in such state, the main air flow paths 40A, 40B, 40C, 40D and 40E communicating with each other communicate with the interior of the sealing member 33.

Figure 10:
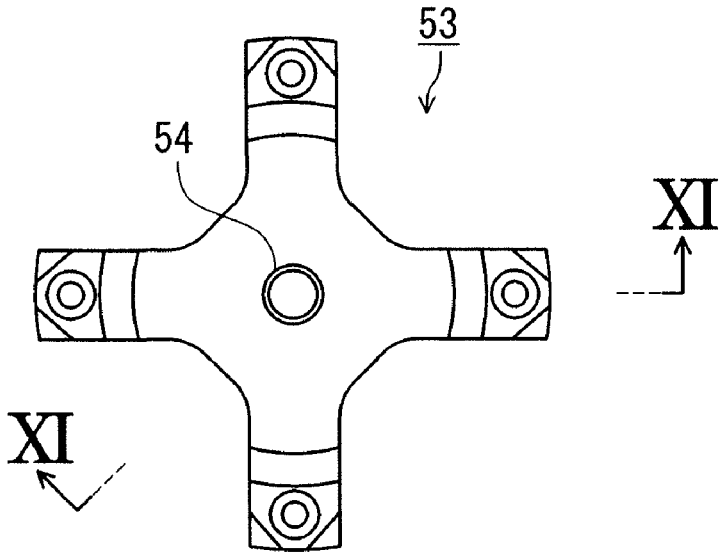
FIG. 10 is a plan view illustrating a sealing jig mounting plate as an insulating member in FIG. 3.
Figure 11:
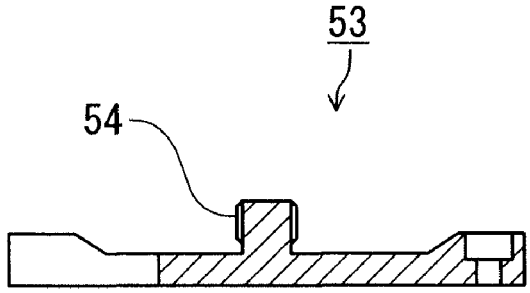
FIG. 11 is a sectional view taken along the line XI-XI in FIG. 10.

As illustrated in FIG. 2, the sealing jig 13 is installed on an upper end of the electrode 12 through a sealing jig mounting plate 53 as an insulating member. The sealing jig mounting plate 53, as illustrated in FIGS. 2, 10, and 11, is formed into a substantially cruciform shape and an external thread portion 54 for fastening is formed in the center of the sealing jig mounting plate 53. A front end portion of the approximately cross-shaped sealing jig mounting plate 53 is fixed on the electrode 12 by bolts 55. The external thread portion 54 of the sealing jig mounting plate 53 is screwed into an internal thread portion 42 in the lower plate 34 of the sealing jig 13. The sealing jig 13 constructed by integrating the sealing member 33, the lower plate 34, and the seal base 35 is installed on the sealing jig mounting plate 53.

The sealing jig mounting plate 53 is made of non-conductive resin and insulates the lower plate 34 and the seal base 35 made of conductive metal from the electrode 12. The treatment liquid flows toward the slit 26 as shown by an arrow in FIG. 2 passing through a cut-out portion of the sealing jig mounting plate 53 having a substantially cruciform shape.

The air joint 15 illustrated in FIGS. 1 and 2 includes a main air supply path 56 in addition to the main air coupling 22 as described hereinbefore. The main air coupling 22 is connected to an air supply valve and a compressor, not shown, through a main air supply pipe 57.

When the electrode 12 is inserted into the cylinder 2 of the cylinder block 1, the air joint 15 comes into contact with the seal sheet 48 of the sealing jig 13 installed on the electrode 12, and the main air supply path 56 communicates with the main air flow path 40A of the seal sheet 48. Air is supplied from the main air supply path 56 to the main air flow path 40A, and, at this time, air leakage is prevented by the seal sheet 48.

The air supplied from the main air supply path 56 to the main air supply path 40A is introduced into the sealing member 33 through the main air flow paths 40B, 40C, 40D and 40E as illustrated in FIG. 3. To the sealing member 33, the upper side surface 33B is supported by the seal base 35 and the lower side surface 33C is supported by the lower plate 34 to regulate the expansion of the sealing member 33.

Accordingly, as illustrated in FIG. 3A, the sealing member 33 expands only in a radial direction, and the outer peripheral portion 33A of the sealing member 33 comes into contact with the cylinder inner peripheral surface 3 of the cylinder block 1 to thereby seal the crankcase surface 5 side of the cylinder inner peripheral surface 3. Hence, the plating-preprocessing liquid or plating liquid can be prevented from leaking from the space 27 (FIG. 2) partitioned by the cylinder inner peripheral surface 3 and the outer peripheral surface of the electrode 12 toward the crankcase surface 5 side.

When the air supply from the main air coupling 22 to the sealing member 33 is shut down, the sealing member 33 contracts in a radial direction and the outer peripheral portion 33A thereof is separated from the cylinder inner peripheral surface 3, as illustrated in FIG. 3B.

A device for confirming the expansion and contraction of the sealing member 33 is provided for the sealing jig 13 and the air joint 15. The confirming device is composed of a sub-air coupling 58 and a sub air supply path 59 on the air joint 15 side, a sub-air flow path on the seal jig 13 side, an air pressure sensor 61 and a control circuit 62.

A plurality of sub-air couplings 58, for example three sub-air couplings 58, is arranged on the air joint 15. A plurality of sub-air supply paths 59, for example three sub-air supply paths 59, is formed on the air joint 15 correspondingly to the sub air couplings 58, and each of the sub-air supply paths 95 communicates with the sub air coupling 58.

The sub-air flow path 60 is formed on the seal base 35 of the sealing jig 13. As illustrated in FIGS. 8 and 9, a plurality of concentric ring grooves 63, for example three concentric ring grooves 63, are formed on a top surface of the swelling portion 46 of the seal base 35 correspondingly to the number of the sub-air supply paths 59, and each of the concentric ring grooves 63 communicates with each of the sub-air supply paths 59. A plurality of the sub-air flow paths 60 (e.g. three) are radially formed at uniform intervals correspondingly to the number of the ring grooves 63. Each of the sub-air flow paths 60 communicates with each of the ring grooves 63, and is formed with a blowing-off hole 64 at an outer peripheral end portion of the seal base 35.

The blowing-off hole 64 is positioned so as to be closed by the sealing member 33 at the time of the expansion of the sealing member 33 and to be opened at the time of the contraction of the sealing member 33, as illustrated in FIG. 3.

The air as a fluid introduced from the sub-air coupling 58 provided on the air joint 15 illustrated in FIG. 2 passes through the sub-air supply path 59 and blows off from the blowing-off hole 64 via the ring groove 63 and the sub air-flow path 60 in the sealing jig 13 (FIG. 3). The air from the blowing-off hole 64 is blown off when the blowing-off hole 64 is opened without being closed by the sealing member 33 at the contraction of the sealing member 33, as illustrated in FIG. 3B. At this time, air pressure is decreased in the sub-air flow path 60, the sub-air supply path 59, and the sub air coupling 58. On the contrary, at the time of the expansion of the sealing member 33, as illustrated in FIG. 3A, air does not blow off from the blowing-off hole 64 as a result of the blowing-off hole 64 being closed by the sealing member 33 and the air pressure is increased in the sub-air flow path 60, the sub-air supply path 59, and the sub-air coupling 58.

The air pressure sensors 61 illustrated in FIG. 2 are arranged on sub-air supply pipes 65, for example three sub-air supply pipes 65, for introducing the air to the sub-air couplings 58. The air pressure sensor 61 detects air pressure in the sub-air flow path 60. From the detected values of air pressures, the expansion or contraction of the sealing member 33 of the sealing jig 13 can be confirmed. Specifically, it can be confirmed that the sealing member 33 expands and comes into contact with the cylinder inner peripheral surface 3 of the cylinder block 1 to liquid-tightly seal the cylinder inner peripheral surface 3 or that the sealing member 33 contracts and does not come into contact with the cylinder inner peripheral surface 3 of the cylinder block 1 so that the cylinder inner peripheral surface 3 is unsealed.

A detailed example of the confirmation of the sealing by the air pressure will be described below. For example, in a case where the air is supplied to the sub-air flow path 60 with air pressure supplied from the sub-air coupling 58 taken as 0.10 MPa, the air pressure in the sub-air flow path 60 is 0.09 to 0.10 MPa in an expanded state of the sealing member 33.

Although the air pressure in the sub-air flow path 60 may lower due to malfunction or deterioration of the sealing member 33, when the air pressure is within the range of 0.06 to 0.10 MPa, it can be confirmed that the sealing member 33 expands to contact the cylinder inner peripheral surface of the cylinder block 1, and the cylinder inner peripheral surface 3 is sealed by the sealing member 33. On the contrary, when the air pressure in the sub-air flow path 60 is 0.05 MPa or less, it can be confirmed that the sealing member 33 contracts and does not come into contact with the cylinder inner peripheral surface 3 of the cylinder block 1 and the cylinder inner peripheral surface is not sealed by the sealing member 33, thus confirming that the liquid may leak.

The sealing on the cylinder inner peripheral surface 3 of the cylinder block 1 by the expansion and contraction of the sealing member 33 is confirmed over all the circumstance of the sealing member 33 because a plurality of sub-air flow paths 60 are formed at uniform intervals in a circumferential direction of the seal base 35 (i.e., sealing member 33), for example three sub-air flow paths 60, are formed at uniform intervals of 120 degrees in a circumferential direction of the sealing member 33.

Hence, the expanded and contracted states of the sealing member 33 can be confirmed, and thus sealing of the cylinder inner peripheral surface 3 can be confirmed even if deterioration, cracking or breakage occurs at a portion of the sealing member 33 in a circumferential direction, and the sealing member 33 expands normally at any portion except the occurrence portion and expands insufficiently at any failed portion such as cracking and does not come into contact with the cylinder inner peripheral surface 3 of the cylinder block 1.

The control circuit 62 illustrated in FIG. 2 fetches detected values from the air pressure sensor 61 and controls the driving of the liquid supply pump 24 and the power supply 30. Specifically, the control circuit 62 determines that when a detected value from the air pressure sensor 61 is higher than a predetermined value, the sealing member 33 of the sealing jig 13 expands and contacts the cylinder inner peripheral surface 3 of the cylinder block 1 and the cylinder inner peripheral surface 3 is sufficiently sealed. At this time, the control circuit 62 starts the liquid supply pump 64 to supply treatment liquid to the space 27 partitioned by the cylinder inner peripheral surface 3 and the outer peripheral surface of the electrode 12, then drives the power supply device 30 to supply the electric power to the electrode 12 and performs pre-plating or plating on the cylinder inner peripheral surface 3.

The control circuit 62 determines that when a detected value from the air pressure sensor 61 is the predetermined value or lower, the sealing member 33 of the sealing jig 13 does not expands properly and otherwise contracts and does not come into contact with the cylinder inner peripheral surface 3, and the cylinder inner peripheral surface 3 is sealed incompletely. In this case, the control circuit 62 does not drive the liquid supply pump 24 or the power supply device 30, or stop the driving of the liquid supply pump 24 and the power supply 30.

According to the present embodiment, the following advantages or effects (1) to (5) will be provided.

(1) For the sealing member 33 of the sealing jig 13, since the upper side surface 33B is supported by the seal base 35 and the lower side surface 33C is supported by the lower plate 34, the expansion of the sealing member 33 is regulated by the lower plate 34 and the seal base 35 at the time of the air introduction into the sealing member 33, whereby the expansion is caused only in a radial direction and bringing the outer peripheral portion 33A into contact with the cylinder inner peripheral surface 3 of the cylinder block 1. Hence, the sealing member 33 coming into contact with the cylinder inner peripheral surface 3 can be precisely positioned.

When a plating film is applied to the cylinder inner peripheral surface 3 of the cylinder block 1, a plating area can be highly precisely controlled according to the present embodiment, whereby the cylinder block 1 having a high-quality plating film can be manufactured.

(2) The sub-air flow path 60 provided with a blowing-off hole 64 for blowing off air is formed to the seal base 35 of the sealing jig 13. The blowing-off hole 64 is closed by the sealing member 33 when the sealing member 33 is expanded in a radial direction and is opened when the sealing member 33 is contracted. The fact whether the sealing member 33 is contacted or not to the cylinder inner peripheral surface 3 is confirmed based on air pressure in the sub-air flow path 60. Accordingly, only when the sealing member 33 comes into contact with the cylinder inner peripheral surface 3 and the inner-periphery surface 3 is sealed by the sealing member 33, the treatment liquid is introduced into the space 27 including the inner-periphery surface 3, thus preventing the liquid from leaking in the space 27.

Furthermore, in a case where the contacting condition between the cylinder inner peripheral surface 3 and the sealing member 33 has been interrupted during a time when the treatment liquid is being introduced into the space 27, the supply of the treatment liquid to the space 27 is stopped, thereby preventing the liquid from leaking in the space 27.

(3) A plurality of sub-air flow paths 60 having the blowing-off hole 64 for confirming the expansion and contraction of the sealing member 33 are provided to the seal base 35 of the sealing jig 13 along a circumferential direction of the sealing member 33. Accordingly, even if deterioration, cracking or breakage occurs at a portion of the sealing member 33 and the expansion of the sealing member 33 becomes insufficient as a result at this portion, such a partial failure of the sealing member 33 can be surely detected, whereby defective sealing of the cylinder inner peripheral surface 3 can be surely confirmed.

(4) In order to expand and contract the sealing member 33, air is supplied to the sealing member 33 of the sealing jig 13 from the main air coupling 22 of the air joint 15 through the main air flow paths 40A, 40B, 40C, 40D and 40E. For confirmation of such expansion and contraction of the sealing member 33, air is supplied to the sub-air flow path 60 having the blowing-off hole 64 from the sub-air coupling 58 of the air joint 15.

In a case where a motor-driven mechanism having electric switches and electric wires is used for the expansion and contraction of the sealing member 33 and for the confirmation thereof, electrical malfunction may occur due to the influence of the electrode 12, and the electric wires may be damaged by highly corrosive treatment liquid such as phosphoric acid or sulfuric acid, and as a result, the durability may be degraded.

The expansion and contraction of the sealing member 33 and confirmation thereof are pneumatically performed as described above, thereby preventing the failures such as electrical malfunction and degradation of durability mentioned above from causing.

(5) Since the sealing jig 13 is installed on an upper end of the electrode 12 through a sealing jig mounting plate 53 as an insulating member, failures such as electrolytic corrosion and adhesion of electrodeposits on the metallic lower plate 34 and seal base 35 of the sealing jig 13 can be prevented from causing.

Further, it is to be noted that the present embodiment describes an example of three sub-air flow paths 60 formed on the seal base 35 of the sealing jig 13 in a circumferential direction, but the number of the sub-air flow paths 60 may be increased or decreased as needed. The sub-air flow path 60 may be formed on the lower plate 34 of the sealing jig 13.

Second Embodiment

FIG. 12

Figure 12:
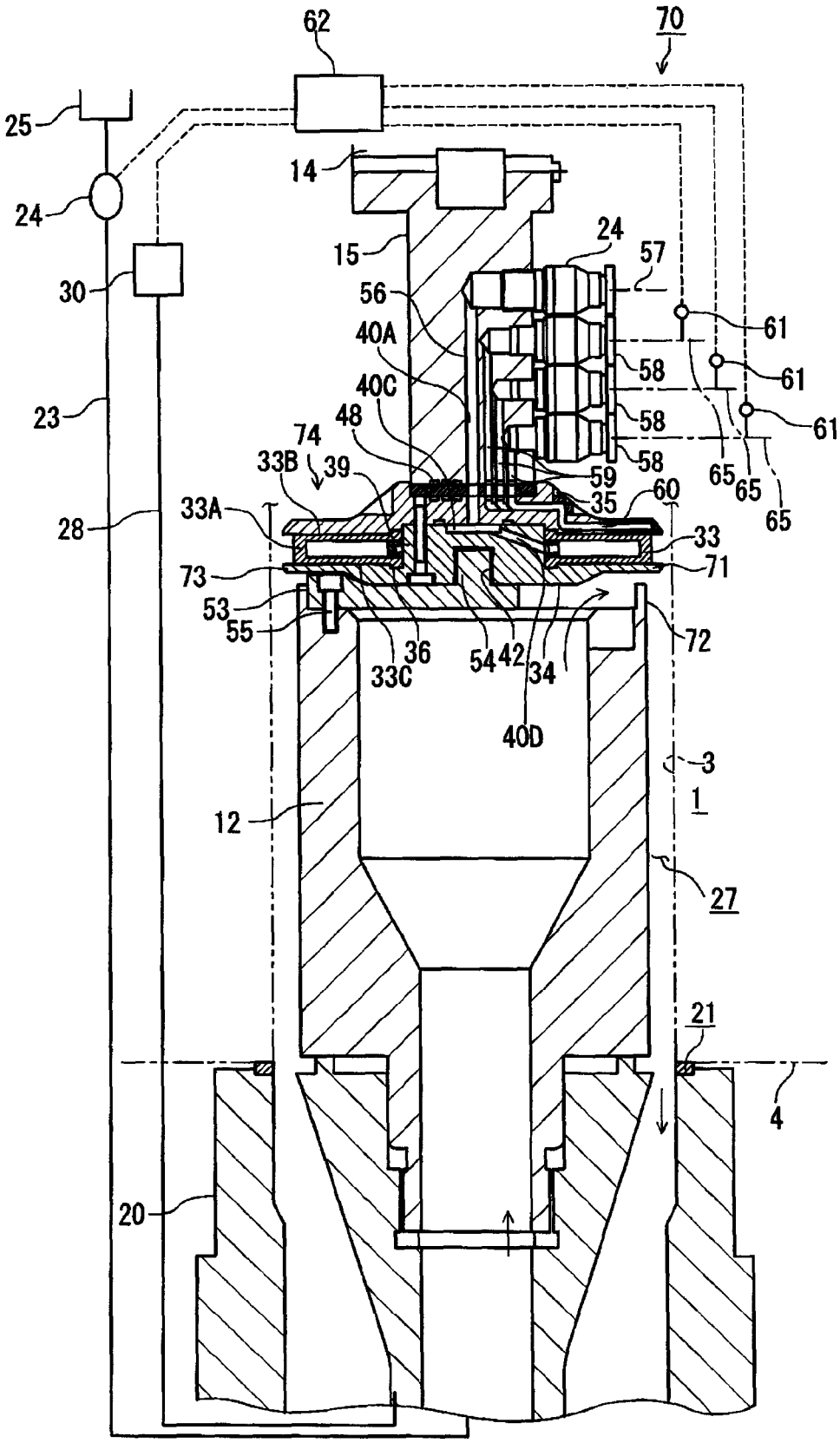
FIG. 12 is a sectional view illustrating a portion around an electrode and an air joint in a second embodiment of a plating treatment apparatus according to the present invention.

FIG. 12 is a sectional view illustrating a portion around an electrode and an air joint in a second embodiment of a plating treatment apparatus according to the present invention. In the second embodiment, the like reference numerals are added to members or portions corresponding to those in the first embodiment, and duplicated descriptions will be simplified or will not be repeated.

Differences of a plating treatment apparatus 70 according to the second embodiment from the plating treatment apparatus 10 reside in that the second embodiment is not provided with a slit 26 (refer to FIG. 2) between the electrode 12 and the lower plate 34 of a sealing jig 74, that the electrode 12 and the lower plate 34 are proximate each other, that an insulation cover 71 is installed on the lower plate 34, and that a communication hole 72 is formed on the electrode 12.

Specifically, the lower plate 34 of the sealing jig 74 is made of metal like the seal base 35 and mounted on the electrode 12 through the sealing jig mounting plate 53 made of an insulation material. The lower plate 34 is formed with a protrusion 73 having a diameter larger than the outer diameter of the electrode 12 and the insulation cover 71 is attached to the lower surface of the protrusion 73 and an outer peripheral portion of the disc portion 32.

The insulation cover 71 is made of an insulation material such as non-conductive resin. The electrode 12 is structured so that the upper end thereof comes into contact with the insulation cover 71 attached to the lower plate 34, and the communication hole 72 is formed in the vicinity of the lower plate 34. The treatment liquid supplied to the electrode 12 flows into the space 27 including the cylinder inner peripheral surface 3 of the cylinder block 1 through the communication hole 72 as illustrated in FIG. 12 and is introduced to the inner peripheral surface 3 of a cylinder. The treatment liquid flows into the electrode 12 from the space 27 including the cylinder inner peripheral surface 3 through the communication hole 72.

Accordingly, the present embodiment provides the following advantages or effects (6) and (7) in addition to the advantages (1) to (5) mentioned in connection with the first embodiment.

(6) The electrode 12 comes into contact with the insulation cover 71 attached to the lower plate 34 of the sealing jig 74, and specifically, the electrode 12 is disposed near the sealing member 33 of the sealing jig 74. Accordingly, a plating film having a uniform thickness is formed up to the end of the crankcase surface 5 side of a plating area in the cylinder inner peripheral surface 3.

(7) In a case where the insulation cover 71 is not attached on the lower plate 34 of the sealing jig 74, the protrusion portion 73 having a diameter larger than the outside of the electrode 12 is formed, and a distance between the protrusion portion 73 and the cylinder inner peripheral surface 3 of the cylinder block 1 becomes short. Therefore, charges tend to concentrate on the protrusion 73 of the lower plate 34, which causes abnormal growth of plating such as a flower shaped portion and excessive etching amount in electrically etching the cylinder inner peripheral surface 3.

On the other hand, according to the present embodiment, the insulation cover 71 is attached onto the protrusion 73 of the lower plate 34, and accordingly, no charges concentrate on the protrusion 73, thus preventing generation of the above flower shaped portion and excessive etching.

Further, in place of attaching the insulation cover 71 onto the lower plate 34 of the sealing jig 74, the lower plate 34 may be made of an insulation material such as non-conductive resin and may be attached to the electrode 12 through the sealing jig mounting plate 53 or directly onto the electrode 12. In such case, substantially the same advantages as those attained in a case where the insulation cover 71 is attached to the lower plate 34 will be attained.

It is further to be noted that the present invention is not limited to the described embodiments and many other changes and modifications may be made without departing from the scopes of the appended claims.

What is claimed is:

1. A sealing jig for sealing an inner peripheral surface of a cylinder in contact with the cylinder inner peripheral surface as a surface to be processed of a cylinder block at a time of introducing treatment liquid to the cylinder inner peripheral surface, the sealing jig comprising:

a sealing member made of an expandable material and having a ring-buoy shape;

a seal support member for supporting one side of the sealing member; and a seal base disposed so as to face the seal support member and adapted to support another side of the sealing member, wherein when the treatment liquid is introduced inward, the sealing member is expanded only in a radial direction under regulation of the seal support member and the seal base so as to come into contact with the cylinder inner peripheral surface.

wherein the seal support member or the seal base is provided with a fluid flow path including a blowing-off hole for blowing off fluid, the blowing-off hole is closed by the sealing member when the sealing member is expanded in a radial direction and is opened when the sealing member is contracted, and a contacting condition of the sealing member with the cylinder inner peripheral surface is confirmed in accordance with a pressure in the fluid flow path.

2. The sealing jig of claim 1, wherein a plurality of fluid flow paths including the blowing-off hole are formed in a circumferential direction of the sealing member.

3. The sealing jig of claim 1, wherein fluid supplied to an interior of the sealing member and fluid supplied to an interior of the fluid flow path including the blowing-off hole are air.

4. A plating treatment apparatus performing a plating treatment to an inner surface of a cylinder, the plating treatment apparatus comprising:

an apparatus body provided with an electrode support member; an electrode supported by the electrode support member to be movable; a sealing jig mounted to the electrode;

a work support jig holding a work; and a treatment liquid supply member supported by the electrode support member for supplying a treatment liquid between the electrode and the sealing jig, the sealing jig comprising:

a sealing member made of an expandable material and having a ring-buoy shape;

a seal support member for supporting one side of the sealing member; and a seal base disposed so as to face the seal support member and adapted to support another side of the sealing member, wherein when the treatment liquid is introduced inward, the sealing member is expanded only in a radial direction under regulation of the seal support member and the seal base so as to come into contact with the cylinder inner peripheral surface, wherein the seal support member or the seal base is provided with a fluid flow path including a blowing-off hole for blowing off fluid, the blowing-off hole is closed by the sealing member when the sealing member is expanded in a radial direction and is opened when the sealing member is contracted, and a contacting condition of the sealing member with the cylinder inner peripheral surface is confirmed in accordance with a pressure in the fluid flow path.

5. The plating treatment apparatus of claim 4, wherein the seal support member for the sealing jig is installed on the electrode and a communication hole through which the treatment fluid inflows and outflows between the electrode inside and the cylinder inner peripheral surface side is formed in a vicinity of the seal support member.

6. The sealing jig of claim 4, wherein the seal support member is made of metal and disposed on the electrode through an insulation member, the seal support member has a protrusion having an outer diameter larger than that of the electrode, and an insulating cover is mounted onto the protrusion.

7. The sealing jig of claim 4, wherein the seal support member includes a protrusion having an outer diameter larger than that of an electrode and is made of an insulation member and installed directly on the electrode or through an insulation member.

* * * * *